US010920432B2

(12) United States Patent
Demuth et al.

(10) Patent No.: US 10,920,432 B2
(45) Date of Patent: Feb. 16, 2021

(54) HIDDEN CLIP AND FASTENING SYSTEM FOR DECKING

(71) Applicant: MN Fastener LLC, Paynesville, MN (US)

(72) Inventors: Nicholas J. Demuth, Cold Spring, MN (US); Mark T. Reum, Avon, MN (US)

(73) Assignee: MN Fastener LLC, Paynesville, MN (US)

( * ) Notice: Subject to any disclaimer, the term of this patent is extended or adjusted under 35 U.S.C. 154(b) by 250 days.

(21) Appl. No.: 15/890,273

(22) Filed: Feb. 6, 2018

(65) Prior Publication Data

US 2018/0223547 A1 Aug. 9, 2018

Related U.S. Application Data

(60) Provisional application No. 62/455,498, filed on Feb. 6, 2017, provisional application No. 62/510,248, filed on May 23, 2017, provisional application No. 62/510,255, filed on May 23, 2017, provisional application No. 62/576,066, filed on Oct. 23, 2017.

(51) Int. Cl.

| | |
|---|---|
| ***B25C 7/00*** | (2006.01) |
| ***E04F 21/22*** | (2006.01) |
| ***E04B 1/00*** | (2006.01) |
| ***E04F 15/02*** | (2006.01) |
| ***B25C 5/16*** | (2006.01) |

(52) U.S. Cl.

CPC ..... *E04F 21/22* (2013.01); *B25C 5/1693* (2013.01); *B25C 7/00* (2013.01); *E04B 1/003* (2013.01); *E04F 15/02044* (2013.01); *E04F 15/02183* (2013.01); *E04F 2015/02094* (2013.01); *E04F 2015/02122* (2013.01); *E04F 2201/05* (2013.01)

(58) Field of Classification Search

CPC . E04F 21/22; E04F 15/02183; E04F 2201/05; B25C 5/1693; B25C 7/00; E04B 1/003

USPC ..... 227/16; 411/442–445

See application file for complete search history.

(56) References Cited

U.S. PATENT DOCUMENTS 3,641,656 A 2/1972 Langas et al.
4,220,070 A * 9/1980 Anstett ..... F16B 15/08 411/444

(Continued)

FOREIGN PATENT DOCUMENTS

WO 2015196108 A1 12/2015

OTHER PUBLICATIONS

Search Report and Written Opinion for PCT/US2018/17129, dated Apr. 25, 2018, 9 pages.

*Primary Examiner* — Michelle Lopez
(74) *Attorney, Agent, or Firm* — Skaar Ulbrich Macari, P.A.

(57) ABSTRACT

A universal magazine mounts to a hand-operated power tool that will automatically feed a hidden deck board clip to the tool head from a strip of such clips and position the clips one at a time under the power tool's driving mechanism. The strip includes multiple hidden clips separated by a frangible section or tab located between adjacent clips. Each hidden clip can be formed of a plastic material and include a locating tab defined on each side of the clip's body and fastener aperture defined in a center of the body. Further, strips can be adapted for manual use and manipulation rather than for use with a power tool.

19 Claims, 27 Drawing Sheets

(56) References Cited

U.S. PATENT DOCUMENTS

| | | | | |
|---|---|---|---|---|
| 4,610,381 | A | 9/1986 | Kramer et al. | |
| 4,801,062 | A | 1/1989 | Austin | |
| 8,256,614 | B1 | 9/2012 | Wadsworth, Sr. | |
| 2005/0063771 | A1* | 3/2005 | Harris | E04F 15/04 403/294 |
| 2011/0123290 | A1* | 5/2011 | Wadsworth | E04F 15/02 411/103 |
| 2011/0126486 | A1 | 6/2011 | Eberle, III | |
| 2015/0202678 | A1 | 7/2015 | Wadsworth | |
| 2015/0275951 | A1* | 10/2015 | Shadwell | F16B 15/08 411/511 |

* cited by examiner

HIDDEN CLIP AND FASTENING SYSTEM FOR DECKING

PRIORITY

This Application claims priority to and the benefit of U.S. Provisional Patent Application No. 62/455,498, filed Feb. 6, 2017, U.S. Provisional Patent Application No. 62/510,248, filed May 23, 2017, U.S. Provisional Patent Application No. 62/510,255, filed May 23, 2017, and U.S. Provisional Patent Application No. 62/576,066, filed Oct. 23, 2017; with each of the above-referenced applications and disclosures fully incorporated herein by reference.

FIELD

The present invention generally relates to building construction, and more particularly to the securing of decking materials requiring mechanical tabs or clips to secure them in place.

BACKGROUND

Extruded decking boards, composite boards, milled wood planking, and the like, may utilize fasteners such as hidden clips to fasten them in place. These hidden clips consist of a body that may be of molded plastic or stamped metal, and have a screw, nail, or formed tab inserted in it.

During use, the hidden clip is inserted into the groove on the board's edge and the fastener is driven through the clip into the joist supporting it, fastening the board edge to the joist. This is a labor-intensive process since the user must hand position each individual hidden clip, hold it in place with one hand, and nail or screw the fastener with the other hand. This hand feed technique is slow and requires two hands. When a board is on an incline or requires force to position it, two persons may be required to lend the third hand to hold it in position while the hidden clip and fastener are secured.

Thus, there is a continuing need for improved securing systems for decking.

SUMMARY

Disclosed is a deck board mounting system for efficiently fastening and mounting hidden clips for decking planks. The disclosure includes a universal magazine that mounts to a hand-operated power tool that will automatically feed attachment clips to the tool head and position them under the nail/screw driving mechanism. This magazine is adaptable to a standard industrial screw gun or nail gun, and utilizes the tool's ability to drive the fastener. The clip feed magazine can be provided in place of the gun's conventional magazine feed components and includes hidden clips provided with a clip strip. The strip includes multiple hidden clips separated by a frangible section or tab located between adjacent clips. Each hidden clip can be formed of a plastic material and include a locating tab defined on each side of the clip's body and fastener aperture defined in a center of the body.

In various embodiments, one or more "dummy" clips can be included at ends of the clip strip and adapted for manual manipulation by a user. In such case, the user would use a conventional screw gun to drive the screw through the clip. The dummy clip facilitates handling of the strip by hand during installation and use, wherein the clips of the strip are manually placed, engaged, and secured to bind the respective clips to the deck board. After use, the dummy clip can be removed from the adjacent clip via severing one or more connecting tabs.

The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
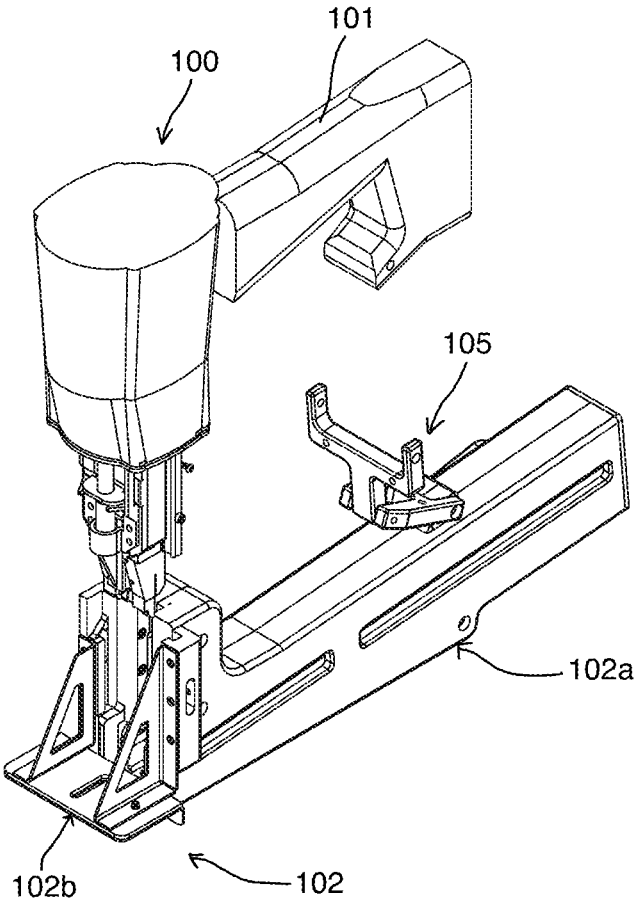
FIGS. 1-3 show various perspective views of a power tool with a generally straight universal magazine attachment for feeding, advancing, and fixating hidden clips to decking boards, in accordance with embodiments of the present invention.
Figure 2:
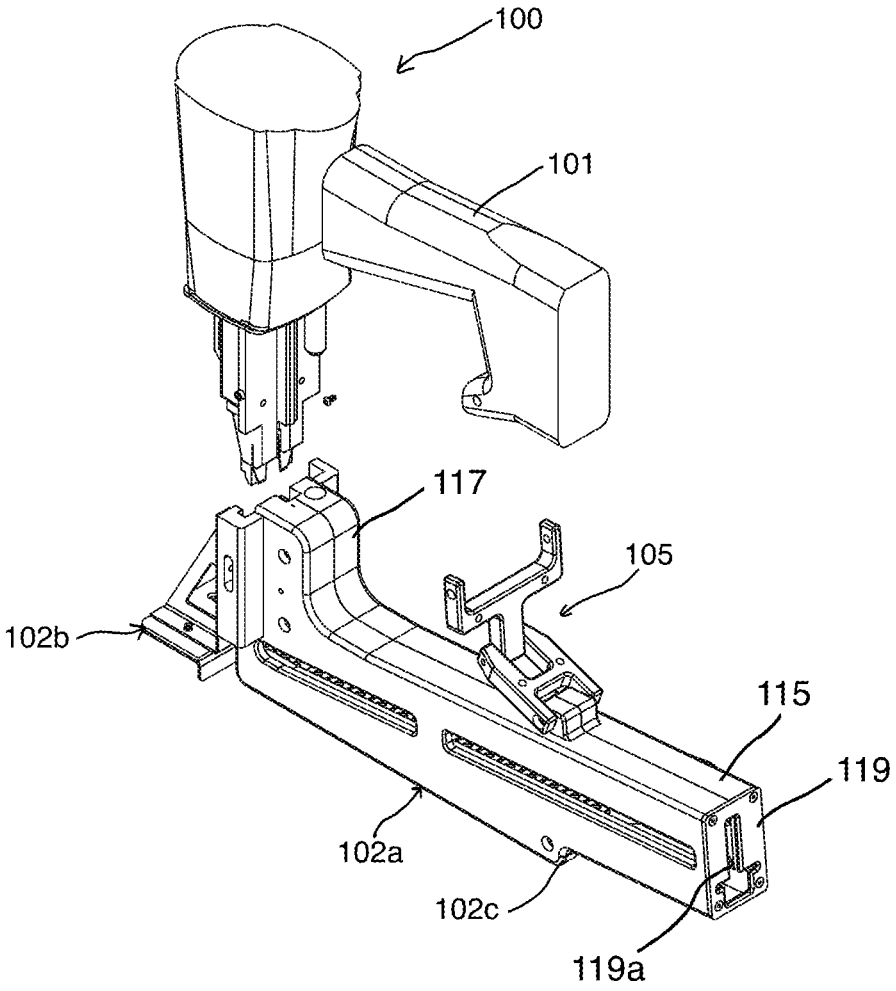
Figure 3:
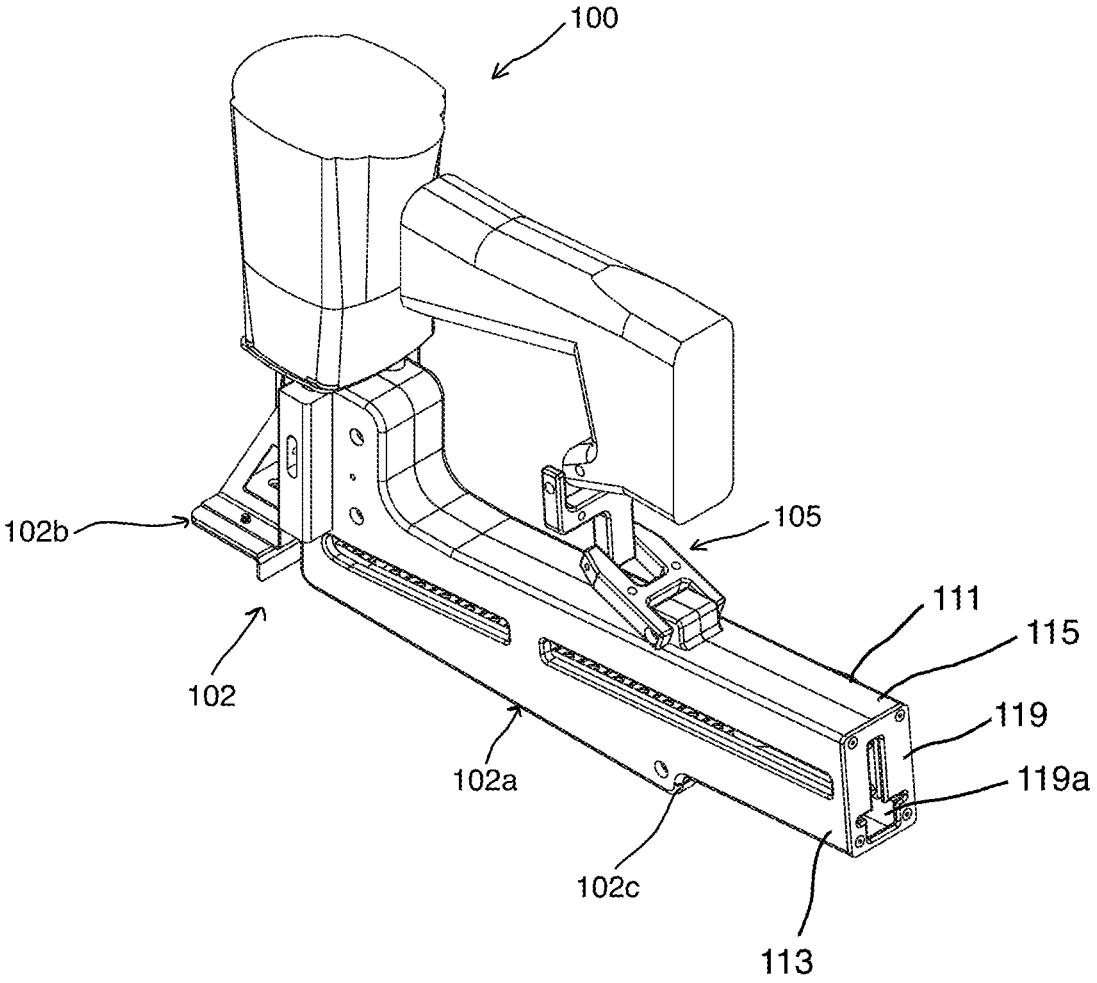
Figure 4:
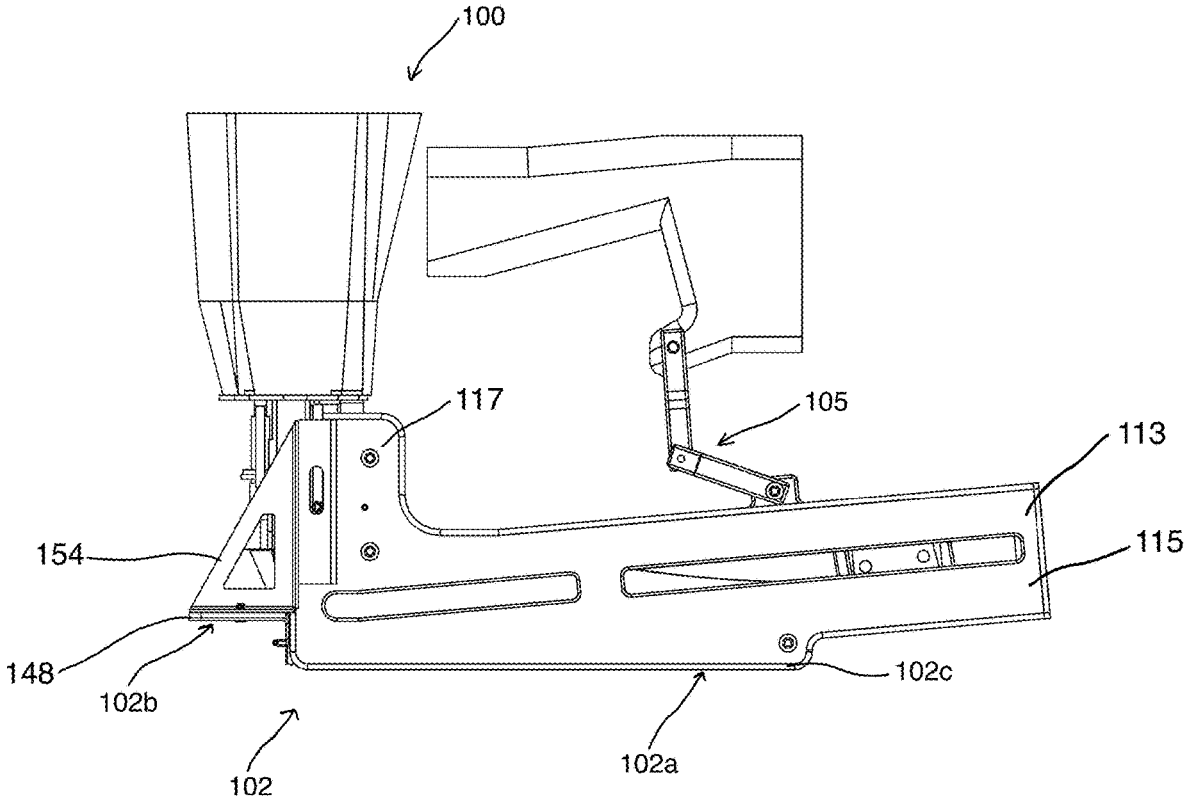
FIGS. 4-5 are side views of a power tool with a generally straight universal magazine attachment for feeding, advancing, and fixating hidden clips to decking boards, in accordance with embodiments of the present invention.
Figure 5:
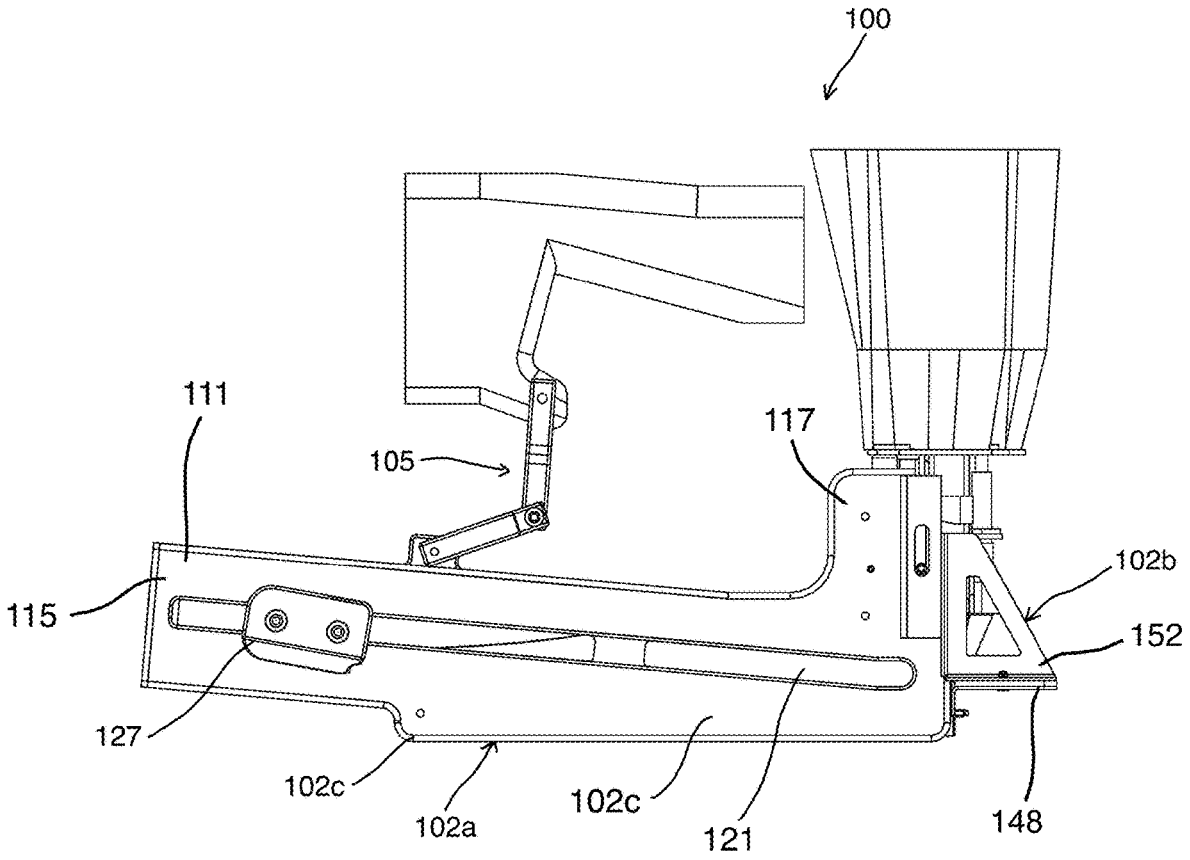

While the invention is amenable to various modifications and alternative forms, specifics thereof have been shown by way of example in the drawings and will be described in detail. It should be understood, however, that the intention is not to limit the invention to the particular exemplary embodiments described. On the contrary, the invention is to cover all modifications, equivalents, and alternatives falling within the spirit and scope of the invention as defined by the appended claims.

DETAILED DESCRIPTION

In the following descriptions, the present invention will be explained with reference to exemplary embodiments thereof. However, these embodiments are not intended to limit the present invention to any specific example, embodiment, environment, applications or particular implementations described in these embodiments. Therefore, description of these embodiments is only for purpose of illustration rather than to limit the present invention.

Dimensions and relative proportions of components are merely example embodiments and can be varied unless specifically limited in a given claim. Thus, the dimensions can be varied without departing from the scope of the invention.

Referring generally to FIGS. 1-11, a power tool 100, such as a commercially available nail or fastener gun, can be modified to include a universal magazine 102 system that feeds hidden clips 104 used to fasten decking boards 106 to a deck frame 108. The systems, devices, components, and methods of the present invention disclosed herein are envisioned for use with other alignment, fastening, and attachment applications as well.

Figure 11:
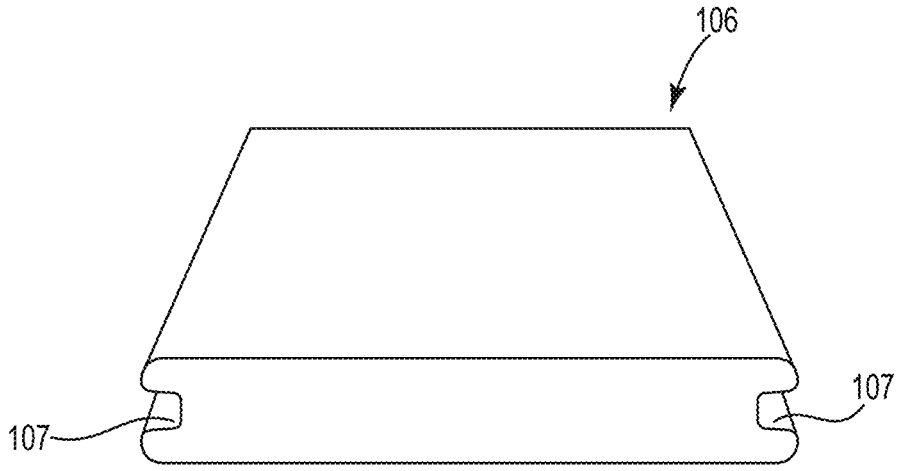
FIG. 11 shows a deck board having longitudinal side grooves to receive hidden clips for securing decking boards in place, in accordance with embodiments of the present invention.
Figure 12:
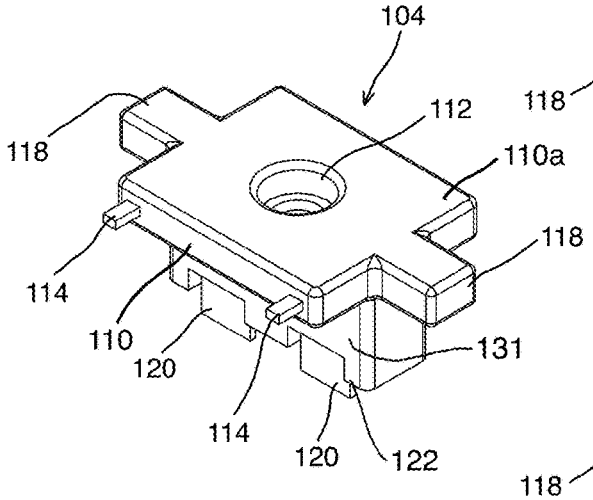
FIG. 12 is a perspective view of a hidden clip for use with a power tool having a universal magazine attachment, in accordance with embodiments of the present invention.
Figure 13:
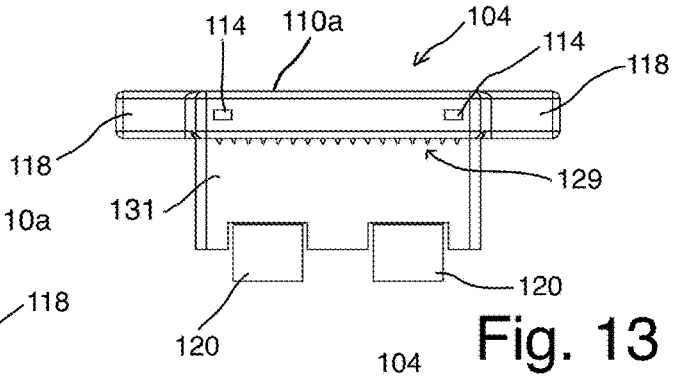
FIG. 13 is a front view of the hidden clip of FIG. 12.
Figure 14:
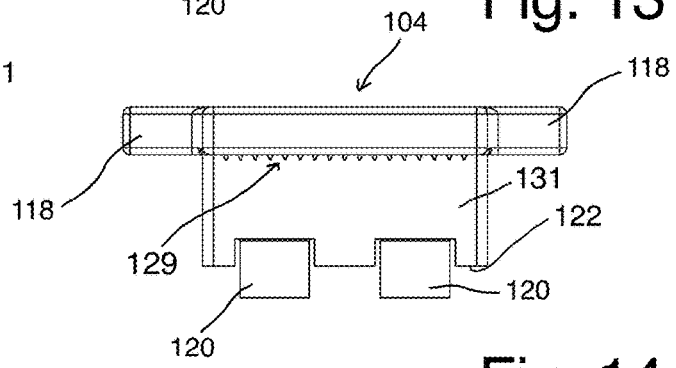
FIG. 14 is a back view of the hidden clip of FIG. 12.

The magazine system 102 includes a magazine feed assembly 102*a* and a nose or hammer assembly 102*b*. A yoke mechanism 105 can selectively and hingedly connect a portion of a handle 101 of the tool 100 with a portion of the magazine feed assembly 102*a*. The magazine 102 can be constructed all or in part of a plastic and/or metal material that holds a strip 116 of clips 104 in queue. When an operator places the driver head of the tool 100 where they want to place or deploy a fastening clip 104, the operator depresses downward on the tool 100. The moveable magazine 102*a* then travels vertically upward with respect to the tool body, about the yoke mechanism 105, which forces the forward-most clip 104 of the strip of clips 116 in the magazine into a knife edge, which cuts that particular clip from the rest of the strip. When the magazine 102*a* has reached full down stroke, a rod in the magazine can depress the tool's trigger safety catch. The trigger is then pulled and the hammer of the tool can drive a fastener through the hidden clip 104 to a desired depth, thereby securing the clip 104 to the frame board 108 and securing the deck board 106 in place. As depicted in FIG. 11, the decking boards 106 include opposing longitudinal side grooves 107 in which the hidden clips 104 are inserted and secured to facilitate board connectivity.

Figure 8:
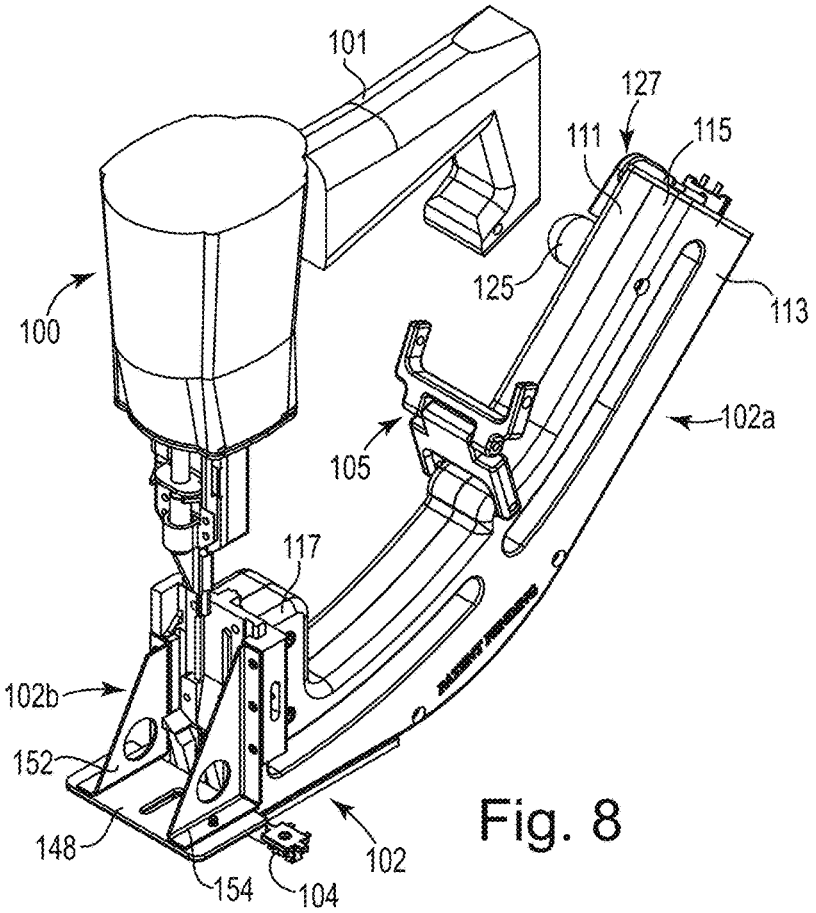
FIGS. 8-9 show various perspective views of a power tool with a curved universal magazine attachment for feeding, advancing, and fixating hidden clips to decking boards, in accordance with embodiments of the present invention.
Figure 9:
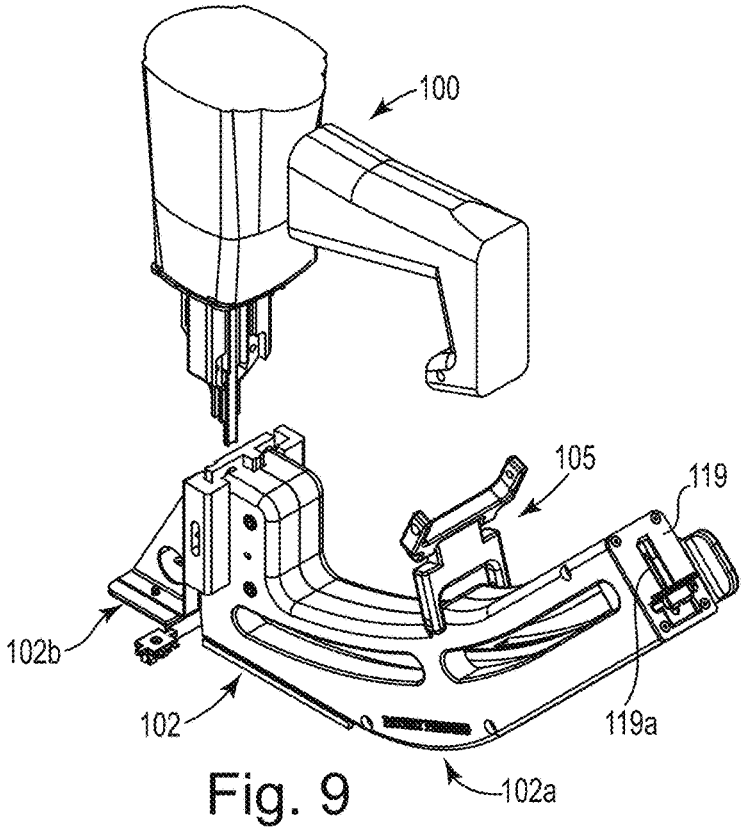
Figure 10:
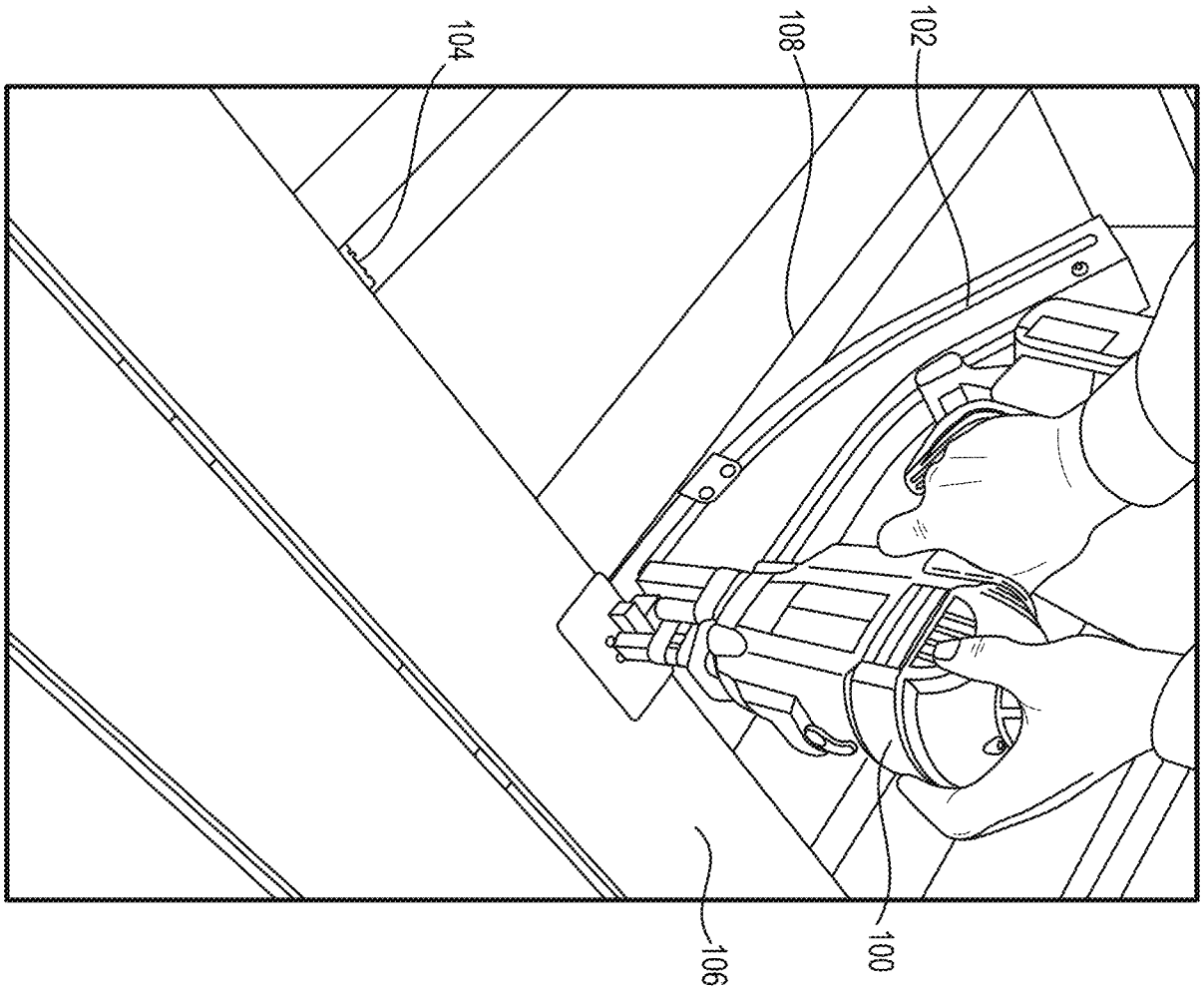
FIG. 10 shows a power tool with a universal magazine attachment in use to fixate hidden clips to a decking board, in accordance with embodiments of the present invention.

Certain embodiments of the magazine feed assembly 102*a* can be generally straight (e.g., FIGS. 1-7), while others can be curved upward or otherwise angled (e.g., FIGS. 8-9). It is noted that the magazine can include various tapers, angles, curves, and the like with various embodiments without deviating from the scope of the present invention.

The magazine feed assembly 102*a* can include a bottom indexing and alignment feature 102*c*. The feature 102*c* can include extending elongated tabs or protrusions adapted to fit on and around a portion of the deck joist or frame 108 to prevent lateral movement and to provide proper alignment of the tool 100 during use.

In certain embodiments, the alignment feature 102*c* is generally U-shaped and can include a gap of approximately 2 inches between the extending tabs to accommodate seating and securement with the positioned frame board 108. A length of the feature 102*c* can be defined in and extend down from each of the magazine 102 halves detailed herein. In other embodiments, the indexing and alignment feature 102*c* can be provided with other components or assemblies of the present invention to facilitate the described functionality.

The magazine assembly 102*a* is configured to serially feed the hidden clips 104 one at a time via a moveable thruster or clip receiver mounted in a groove on a hammer guide plate 140. A self-coiling spring 127*a* disposed within the magazine forces the strip of clips 116 forward.

Referring to FIGS. 3-7, the magazine assembly 102*a* can include a left or first side portion 111 and a right or second side portion 113. Each of the magazine halves includes a rear portion 115 and a front portion 117. The front portion 117 is shaped and configured for receiving and attaching to the various components of the nose assembly 102*b*. The rear portion 115 can include a magazine end cap 119 attachable to each of the portions 111, 113. The clip strip 116 can be fed or loaded into the magazine assembly 102*a* via the end cap 119. The end cap 119 can include a shaped aperture 119*a* adapted to receive the strip 116, including a shaped space to accommodate the clips 104 and corresponding fasteners (e.g., generally T-shaped). The magazine 102 can be molded, cast, stamped, etc.

The left side portion 111 includes a side opening or channel 121 extending along a length of the side 111 and adapted to receive a pusher or thruster device or assembly 127. The pusher device 127 can include a knob 125 or like element for manual manipulation by the operator. The pusher device 127 can include an outer slide plate and an inner slide spring retainer. The pusher device 127 slides along the channel 121 to push or drive the clips 104 of the clip strip 116 toward the nose portion 102*b* of the magazine assembly 102 such that each time a hidden clip securing action is completed, the next clip in line is automatically advanced and ready for fastening. Coil springs and/or a cam drive can be provided to animate the thruster. A slide groove can attach the magazine to the hammer guide plate.

When loading the magazine with a strip of clips 116, for those embodiments using a tool or similar device during operation, the operator pulls or pushes the pusher 127 rearward to a mechanical release catch. The operator then inserts the strip of clips 116 into the empty magazine, via the end cap 119, and releases the catch. The pusher 127 is thus pulled forward by the spring 127*a*, thereby forcing the leading clip 104*a* into the insertion locators in the magazine. A cam mechanism can be utilized to advance the strip of clips in an alternative embodiment. The strip 116 can include a wide variety and number of clips 104, ranging from clip 104*a* . . . 104*n*.

A stroke limiter adjusts the fastener depth. The depth can be manually adjustable by turning a thumbscrew, CW or CCW, to increase or decrease depth. A rigidly mounted spring steel knife 150 separates the leading clip as the magazine travels upwards into the hammer guide plate. The assembly is secured to the tool via an attachment plate, which is configured to mount to a variety of commercially available power tools.

Figure 6:
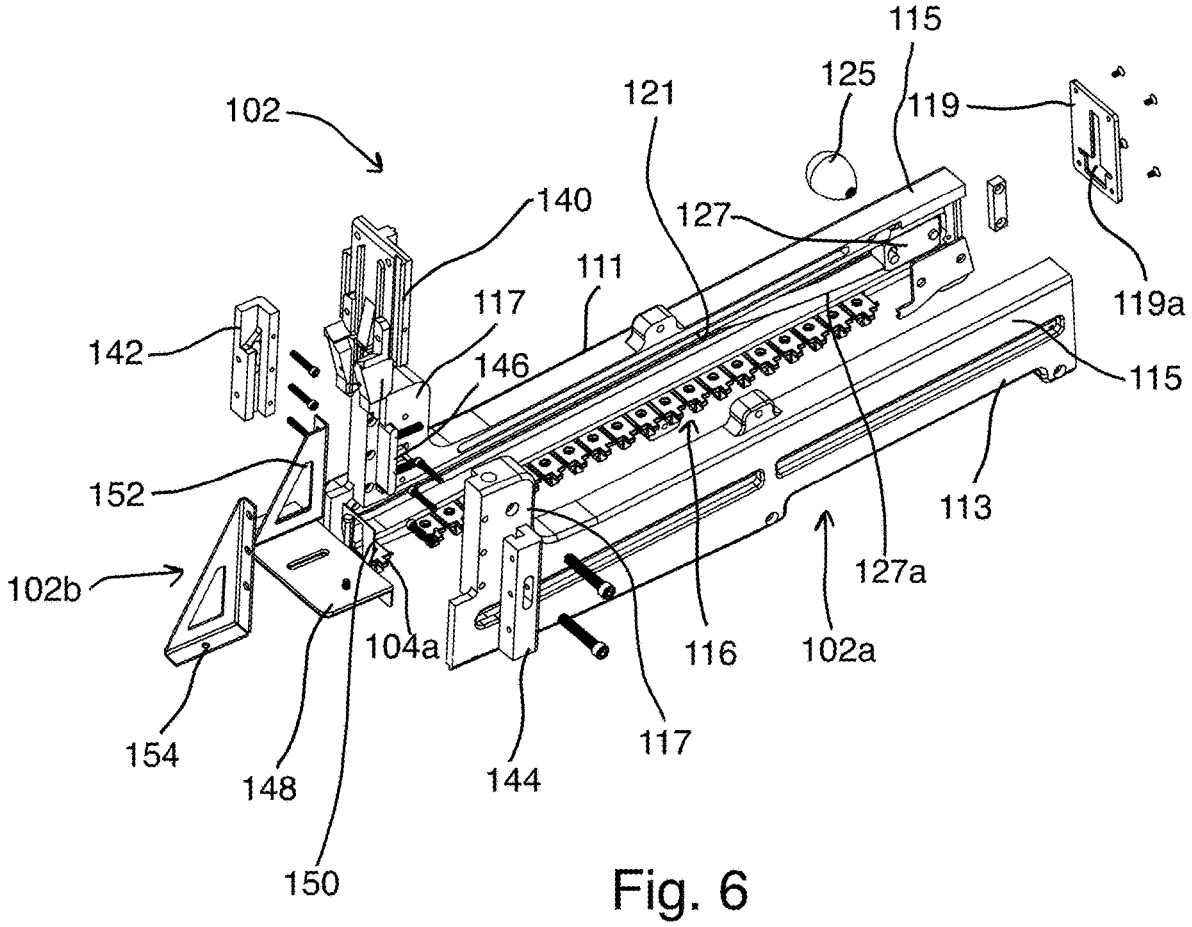
FIG. 6 is an exploded view of a power tool with a generally straight universal magazine attachment for feeding, advancing, and fixating hidden clips to decking boards, in accordance with embodiments of the present invention.
Figure 7:
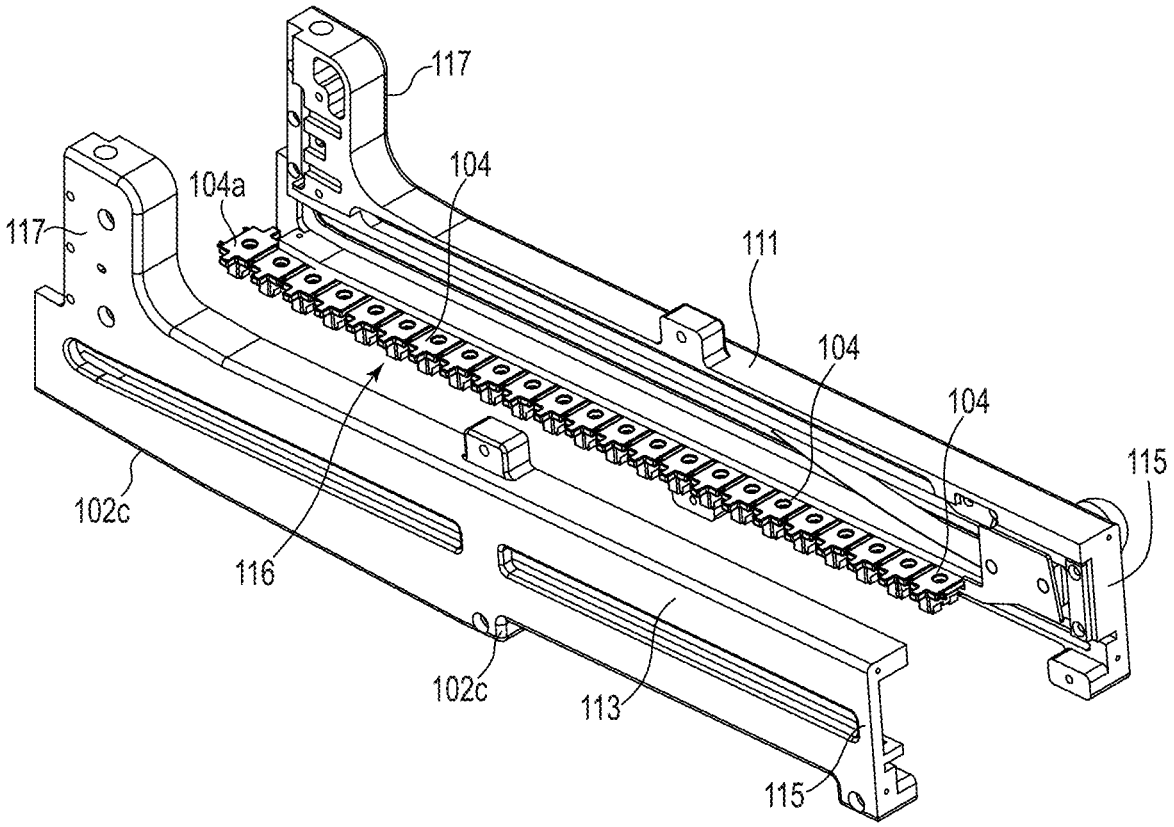
FIG. 7 is an exploded view of a generally straight universal magazine attachment for feeding, advancing, and fixating hidden clips to decking boards, in accordance with embodiments of the present invention.

As illustrated in FIG. 6, the nose or hammer assembly 102*b* includes a hammer guide plate 140, a left nose slide 142, a right nose slide 144, a pusher slide bar 146, a nose locate plate 148, a tab cutter blade 150, a left plate gusset 152, and a right plate gusset 154. Attachment holes, devices, and structures can align with those of the tool 100 for the purpose of mounting the guide plate 140 and magazine assembly 102 to the tool 100.

The hammer guide plate 140 provides reinforcement and guidance for the tool 100 hammer mechanism as it extends and retracts during use, and the plate gussets 152, 154 define the side boundaries for the hammer guide plate 140. When the tool is in position to fasten a hidden clip to a surface, the user pushes the tool 100 downwards, sliding the hammer guide plate 140 upwards and pushing tab cutter blade 150, secured to the guide plate, into the magazine. Such action causes the blade 150 to cut or shear the leading clip (e.g., 104*a*) from the strip 116 and align it for driving. The blade 150 can include one or more cutting edges surfaces to facilitate the described cutting.

When the tool 100 is activated, its hammer forces the fastener 126 to a depth, fastening the clip 104 to the joist (or other surface) below. Each time a hidden clip 104 securing action is completed, the next clip in line is automatically advanced and can be securely located via its tab/recess so that it is ready for fastening.

FIGS. 8-9 show an embodiment of the power tool 100 having a curved universal magazine attachment for feeding, advancing, and fixating hidden clips to decking boards.

Figure 18:
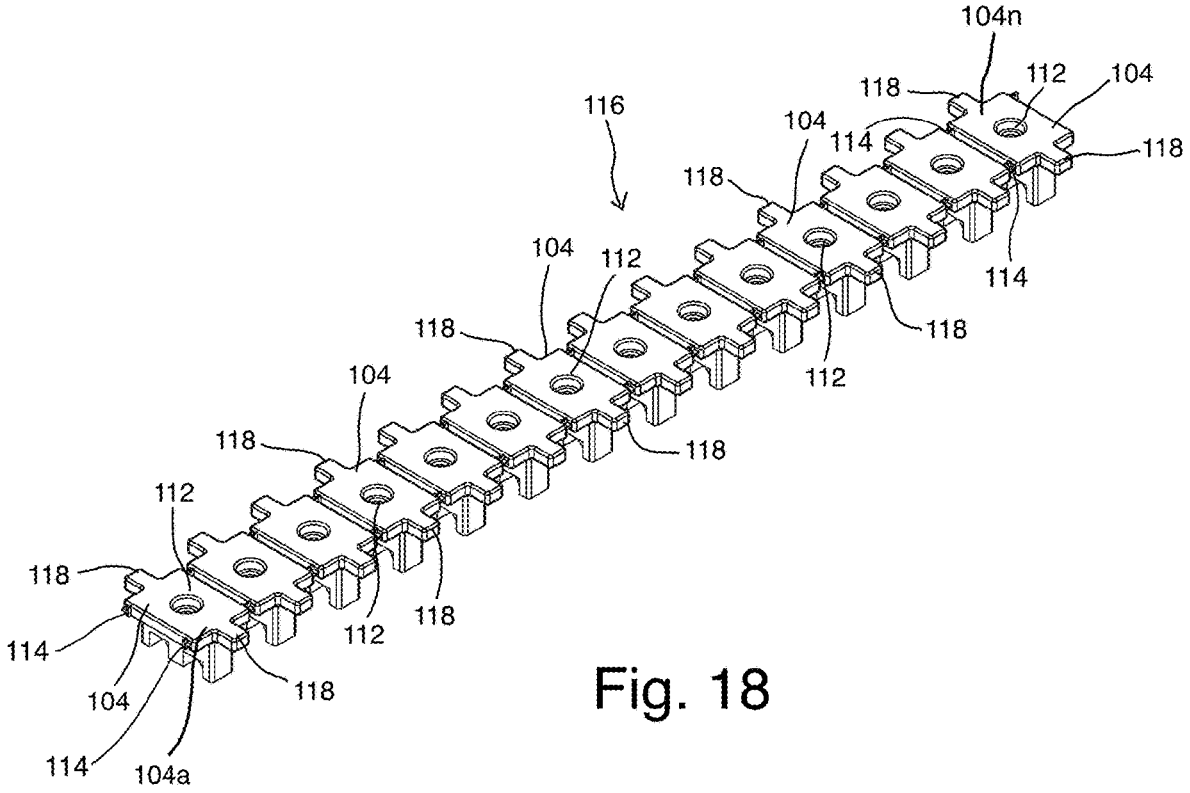
FIG. 18 is a perspective view of a plurality of interconnected hidden clips provided as a strip of clips for feeding through a universal magazine attachment and fixation to decking boards, in accordance with embodiments of the present invention.
Figure 19:
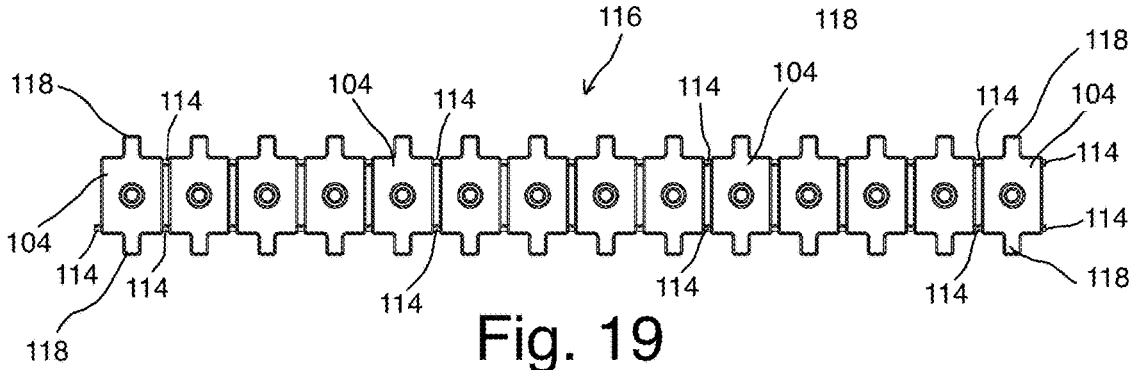
FIG. 19 is a top view of the strip of clips of FIG. 18.
Figure 20:
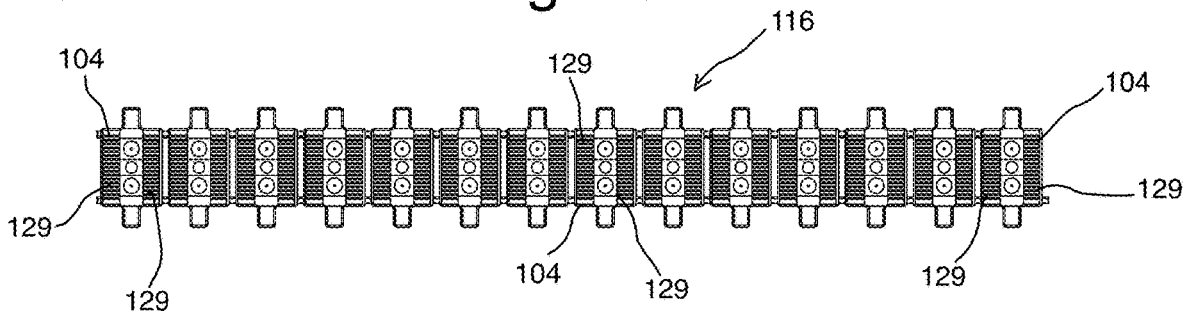
FIG. 20 is a bottom view of the strip of clips of FIG. 18.
Figure 21:
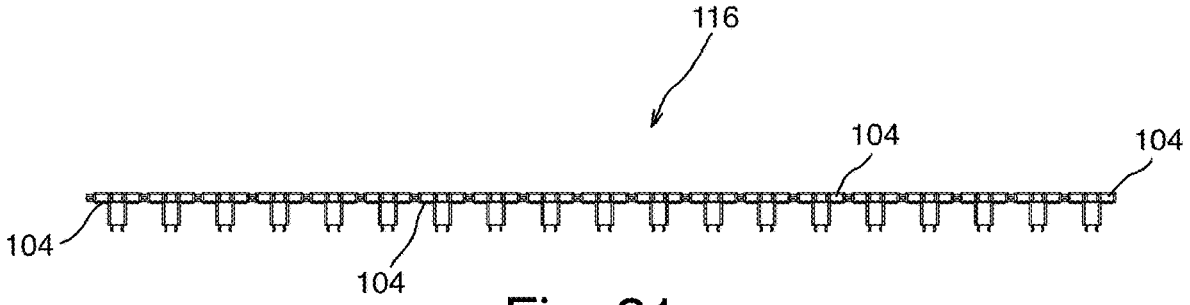
FIG. 21 is side view of the strip of clips of FIG. 18.
Figure 22:
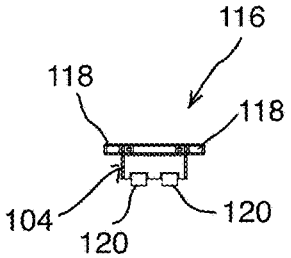
FIG. 22 is a front view of the strip of clips of FIG. 18.

FIGS. 12-18 illustrate an embodiment of a hidden clip 104 and a loadable strip 116 of hidden clips. The clip 104 comprises a molded plastic (or similar material) body 110 that includes one or more extending portions 118 and several novel aspects. The extending portions 118 can assist in alignment/registration and feeding of the hidden clip through the structure of the magazine assembly 102*a*. A center aperture 112 or bore is defined through the vertical height of the clip to permit a screw, nail, or other fastener to secure the clip to a deck frame or other surface. Magazine tabs 114 extend horizontally from an edge of the clip to provide attachment to one or more adjacent clips in a strip of clips 116, as is shown in FIG. 18. The bottom side of the top portion 110*a* of the clip includes or defines a plurality of anti-slip ribs 129.

The lateral protrusion magazine tabs 114 can be made very small (e.g. 20 thousandths of an inch) so that the tabs 114 do not affect the placement of the clip 114 within the groove 107 of the board 106. The magazine tabs 114 in other embodiments can be in the form of a frangible film, either perforated or non-perforated, connecting the adjacent clips. This film in such configuration defines a tear line between adjacent clips.

Figure 15:
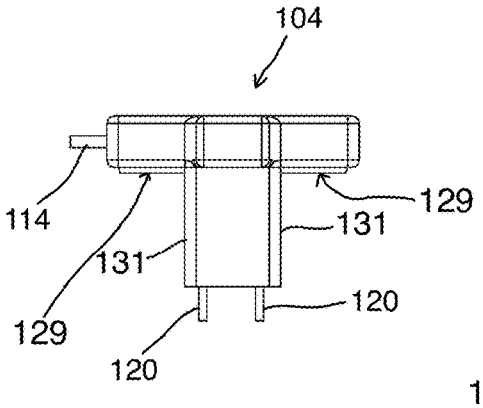
FIG. 15 is a side view of the hidden clip of FIG. 12.
Figure 16:
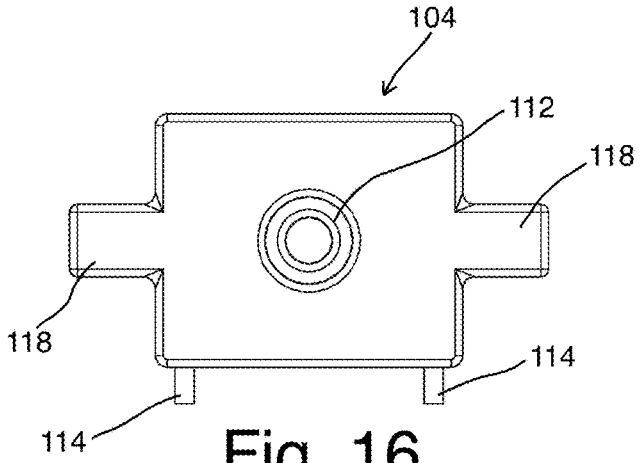
FIG. 16 is a top view of the hidden clip of FIG. 12.
Figure 17:
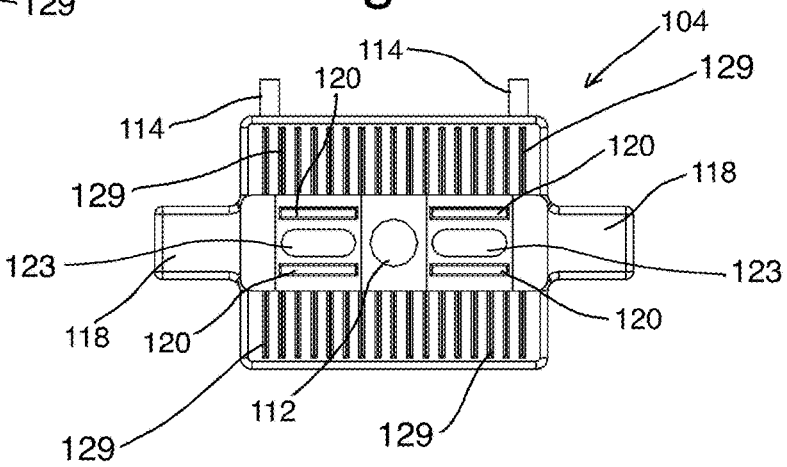
FIG. 17 is a bottom view of the hidden clip of FIG. 12.

As depicted in FIG. 15, the bottom extent of the clip can include one or more compression tabs 120 that are compressed when the clip 104 is secured to the deck frame. The tabs 120 bite downwards into the board 108 for a more secure attachment of the deck boards 106. As such, both a compression and biting functionality can be facilitated with the tabs 120. In certain embodiments, the ribs 129, the bottom tabs 120, or both, can be constructed of a harder material (e.g., harder durometer) than the main clip material to facilitate piercing contact with decking or framing. One or more side walls 131 of the clip 104 can be constructed of a softer material (e.g., softer durometer) then the main clip material to promote slip reduction.

In use, the tabs 120 bind the clip 104 to the deck board 106 when compressed. A dead stop 122 can be defined adjacent to the compression tabs 120 to define the maximum compression at which the clip is seated. A crush aperture or hole 123 can also be defined in the body 110 to allow for future expansion/contraction of adjacent deck boards/flooring. The compression tabs 120 can also provide a universal component to work with different brands of decking with varying center lines, mounting grooves, and like construct requirements.

FIGS. 19-22 show exemplary hidden clips 104 and clip strips 116 in accordance with embodiments of the present invention. Again, extending tabs 114 provide a frangible connection between adjacent clips 104 in the corresponding strip 116. Strips of clips can also be greater or fewer in number than that depicted in the figures.

Figure 23:
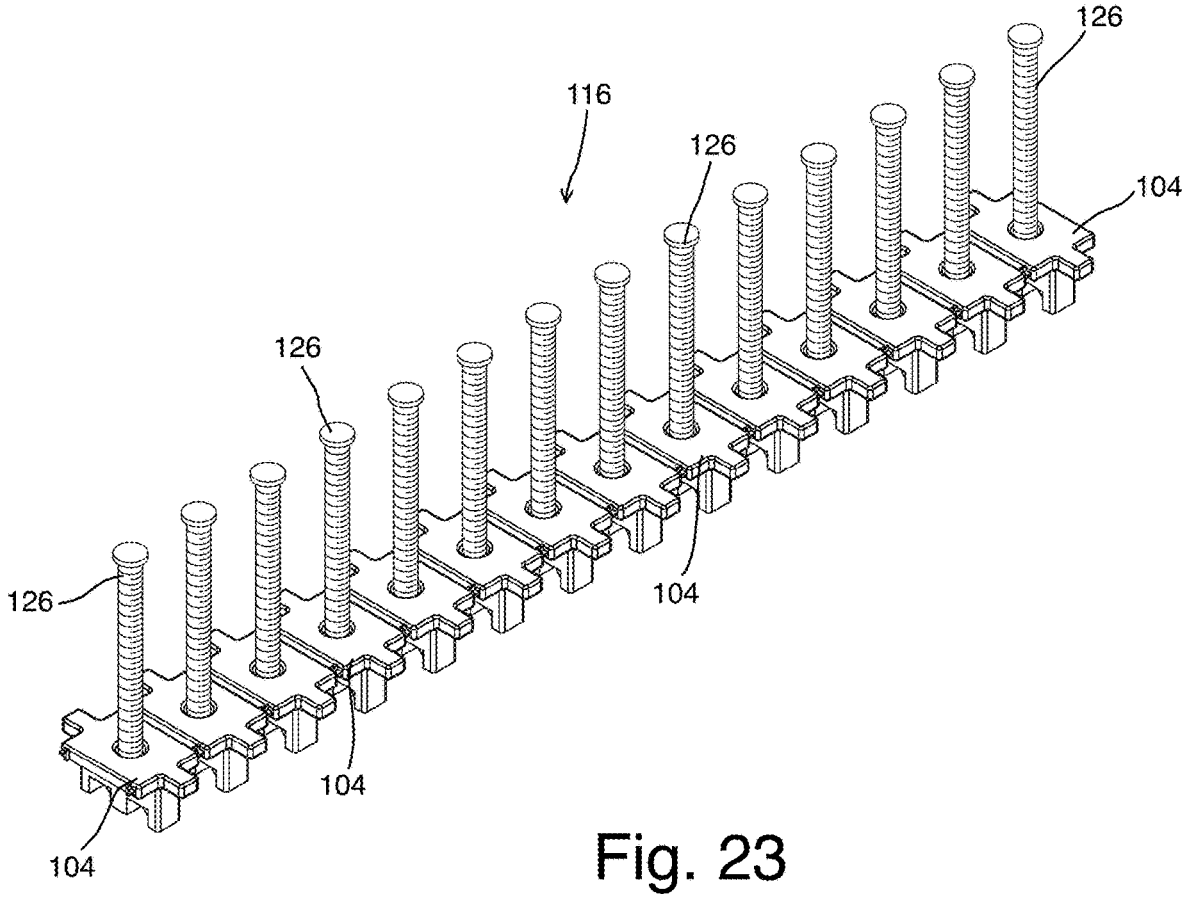
FIG. 23 is a perspective view of a plurality of interconnected hidden clips provided as a strip of clips, with inserted fasteners, for feeding through a universal magazine attachment and fixation to decking boards, in accordance with embodiments of the present invention.

FIG. 23 depicts the strip 116 of hidden clips 104 with a fastener 126 disposed within the center aperture 112 of each clip. The fasteners 126 are inserted shallowly such that the distal threaded end does not extend more than a minimal amount beyond the bottom extent of the clip. The fastener 126 can be a nail, screw, or other suitable fastener. The exemplary fastener of FIG. 23 is a screw.

The strip 116 of clips can be pre-loaded with the fastener 126 as discussed above. This configuration is useful when utilizing the power tool 100 discussed herein. The pre-loaded fasteners 126 in the strip 116 of clips moves the fastener automatically into alignment with the drive head of the tool. This allows the user to advantageously operate the tool with one hand while holding the deck board with their other hand. This allows the user to install the beck boards far faster than the conventional multi-step method of one-at-a-time hand-placed clips and individually placed fasteners for clip, followed by use of a conventional power tool. The pre-loaded fasteners can also be provided for single clips and strips of clips configured for manual installation.

Figure 25:
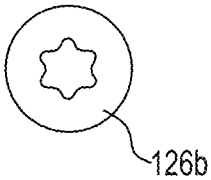
FIG. 25 is a top view of the screw fastener of FIG. 24.
Figure 24:
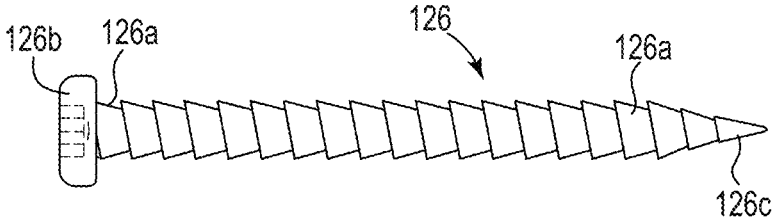
FIG. 24 is a side view of a screw fastener for use with hidden clips, in accordance with embodiments of the present invention.

As shown in FIGS. 24-25, a threaded fastener 126 can include a length of tapered or spiral threading 126*a* that extends from the head 126*b*, or proximate the head 126*b*, all the way to the tip 126*c*, or substantially to the tip 126*c*. The head of the fastener can also be provided with a ballistic shape for rapid linear insertion by a power tool. The fasteners 126 may be molded to, be part of a stamped clip body, or added to a strip 116 after its manufacture. The strip 116 of various depicted embodiments shows the fasteners 126 provided prior to insertion into the magazine 102.

A wide variety of fasteners can be used with the clips described herein. Additional example fasteners include concrete screws for fastening the clips to a concrete substrate instead of to wooden joists 108.

Figure 26:
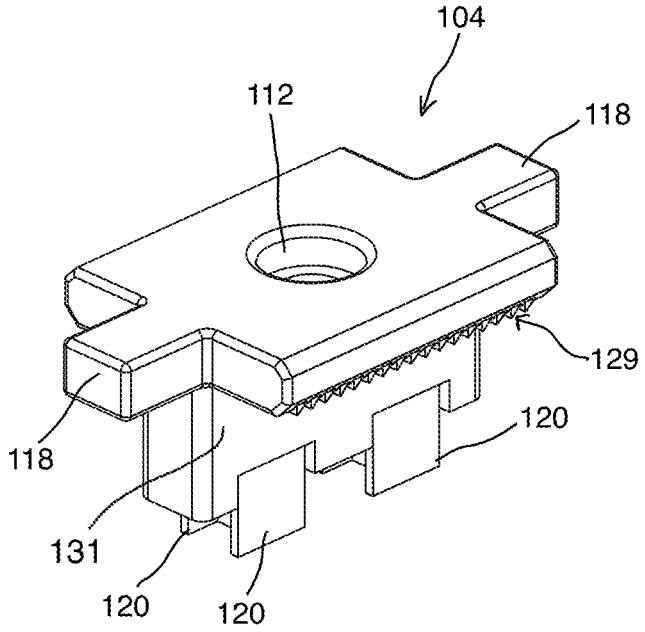
FIG. 26 is a perspective view of a beveled hidden clip for use with a power tool having a universal magazine attachment, in accordance with embodiments of the present invention.
Figure 27:
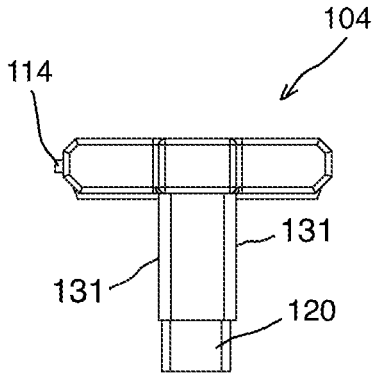
FIG. 27 is a side view of the beveled hidden clip of FIG. 26.

The hidden clip 104 of FIGS. 26-27 include an increased beveled edge (double lead-in) transitioning from the top surface of the clip to the non-slip ribs 129, for easier insertion of the clips. The beveled edge also makes the clip able to accommodate variation of the groove height in the deck boards.

Figure 28:
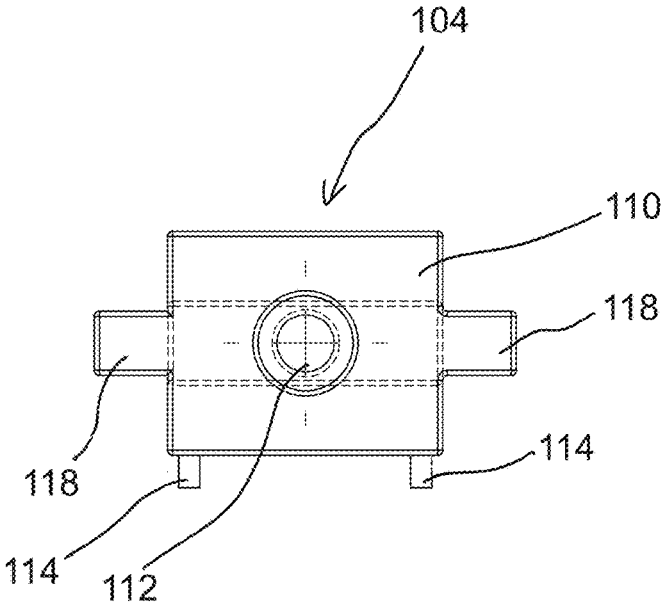
FIG. 28 is a top view of a hidden clip for use with a power tool having a universal magazine attachment, in accordance with embodiments of the present invention.
Figure 29:
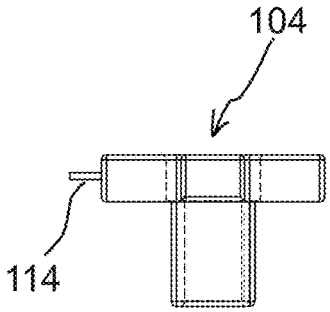
FIG. 29 is a side view of the hidden clip of FIG. 28.

FIGS. 28-29 show an embodiment of the hidden clip 104 not having one or more tabs extending out beyond the bottom surface of the clip 104.

Figure 30:
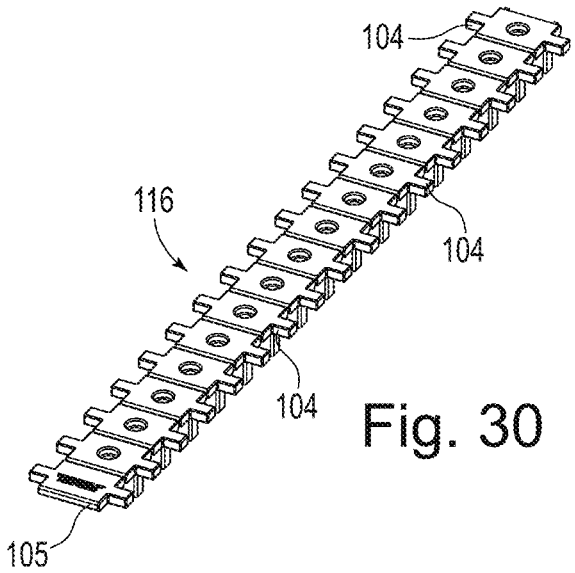
FIG. 30 is a perspective view of a plurality of interconnected hidden clips provided as a strip of clips, for manual manipulation and use to secure decking boards, in accordance with embodiments of the present invention.
Figure 31:
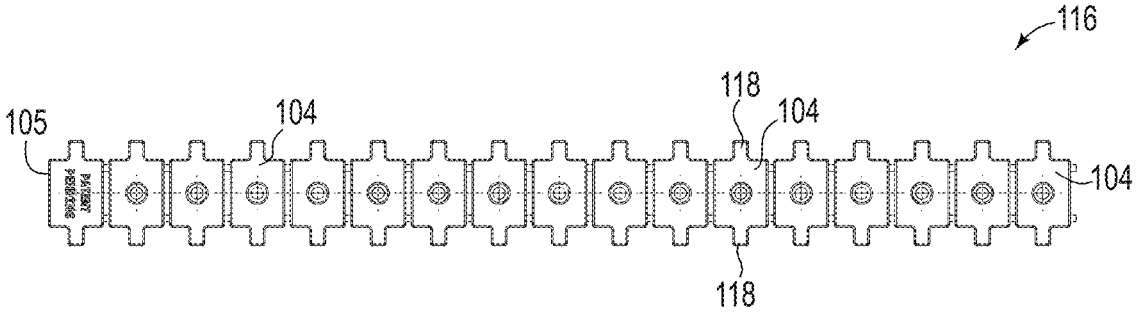
FIG. 31 is a top view of the strip of clips of FIG. 30.
Figure 32:
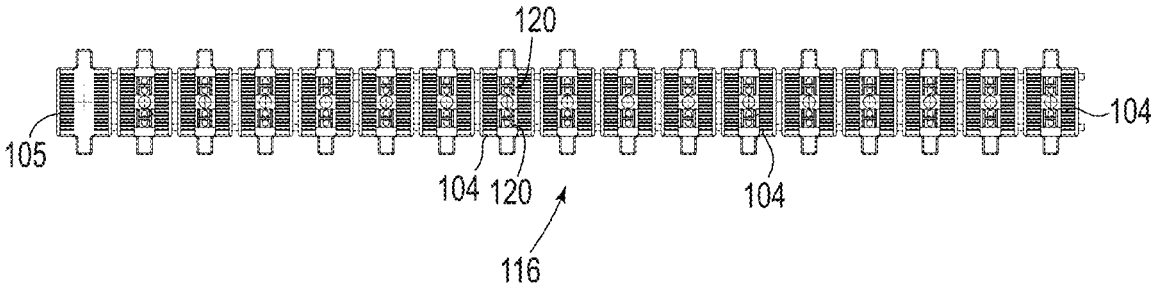
FIG. 32 is a bottom view of the strip of clips of FIG. 30.

FIGS. 30-32 depict the strip 116 of hidden clips 104 for a hand or manually installed and manipulated embodiment of the present invention. One or more "dummy" clips 105 can be included at one or more ends of the strip 116 and adapted for manual grasping by the fingers of a user. The clip 105 facilitates handling of the strip 116 during installation and use, wherein the hidden clips 104 of the strip 116 are manually placed, engaged, and secured to bind the respective clips 104 to the deck board.

The particular clip 105 most remote from the dummy clip 105 is secured to the board with a fastener. After that particular clip 104 is secured, the operator or user can torque the remaining strip of clips 104, or otherwise facilitate breaking, of the secured clip 104 from the strip 116 at the respective frangible tabs 114. This process is repeated until the last clip, which is adjacent to the dummy clip 105, is secured in place. The dummy clip 105 can be removed from the adjacent clip 104 at tabs 114.

Other versions of this embodiment can be adapted for use with a power tool and magazine as well. For example, the dummy clip 105 can be removed prior to insertion of the strip into the magazine of a power tool as discussed herein.

Figure 33:
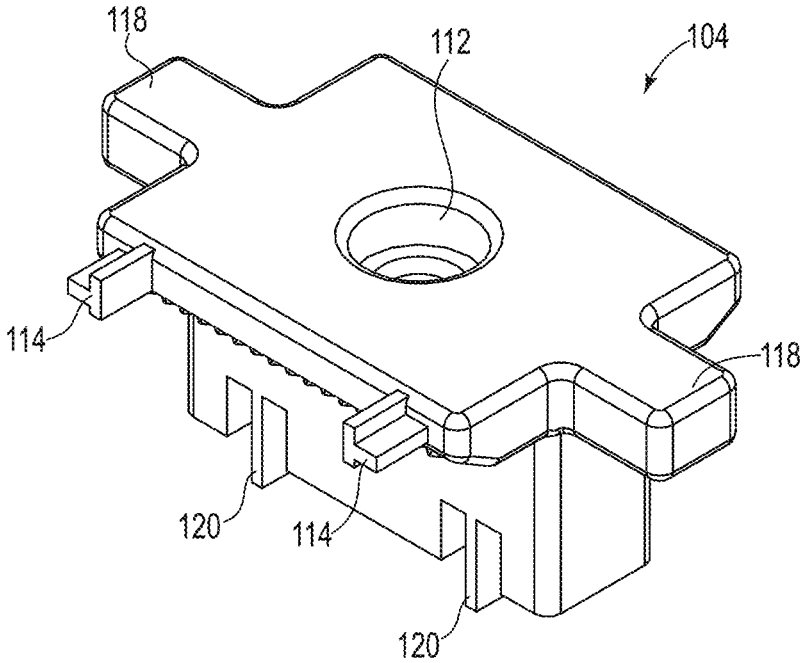
FIG. 33 is a top perspective view of a hidden clip having stepped and angled anti-slip ribs for use with a power tool having a universal magazine attachment, in accordance with embodiments of the present invention.
Figure 34:
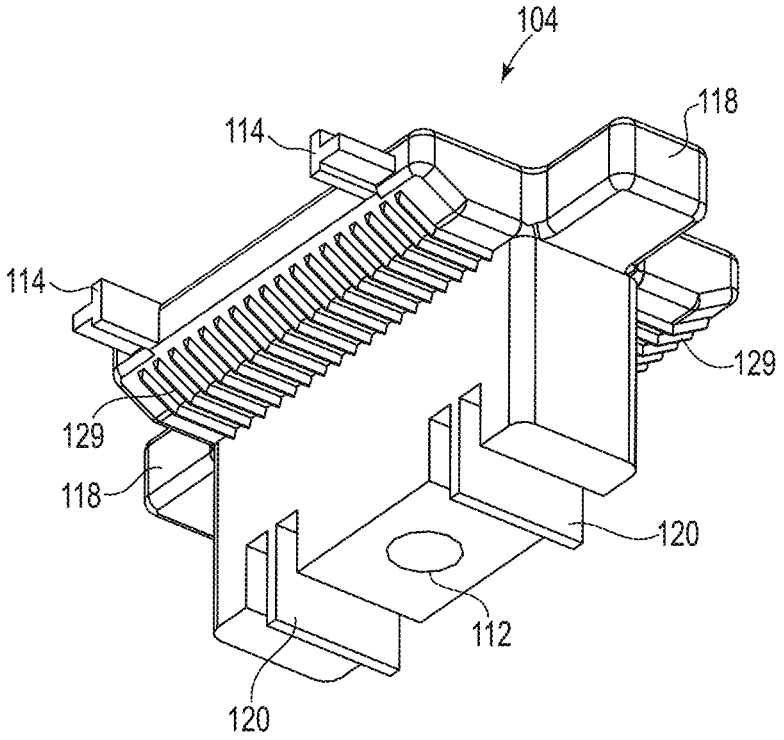
FIG. 34 is a bottom perspective view of the hidden clip of FIG. 33.

FIGS. 33-34 show an embodiment of the hidden clip 104 having generally T-shaped tabs 114 and one or more extending bottom tab 120 features. Further, the non-slip ribs 129 are defined in a stepped and angled configuration. One or more structures or features of this clip 104 can be included with any of the clip embodiments disclosed herein.

Figure 35:
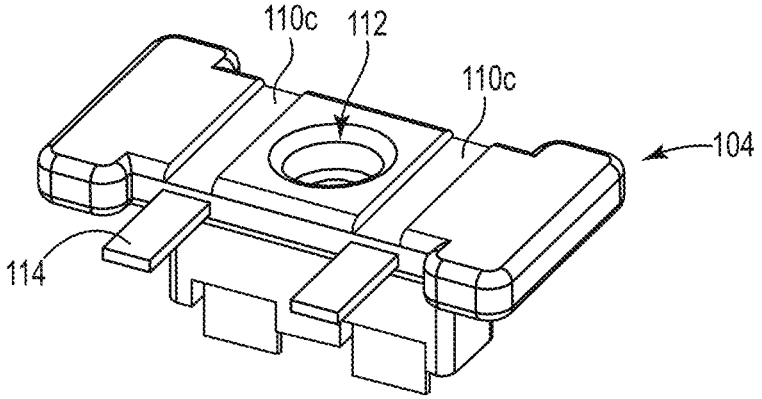
FIG. 35 is perspective view of a hidden clip having tracking grooves, in accordance with embodiments of the present invention.
Figure 36:
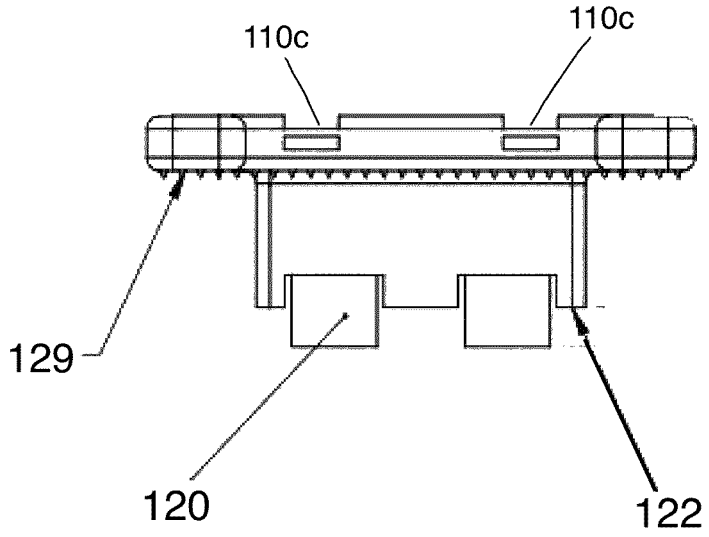
FIG. 36 is front view of the hidden clip of FIG. 35.
Figure 37:
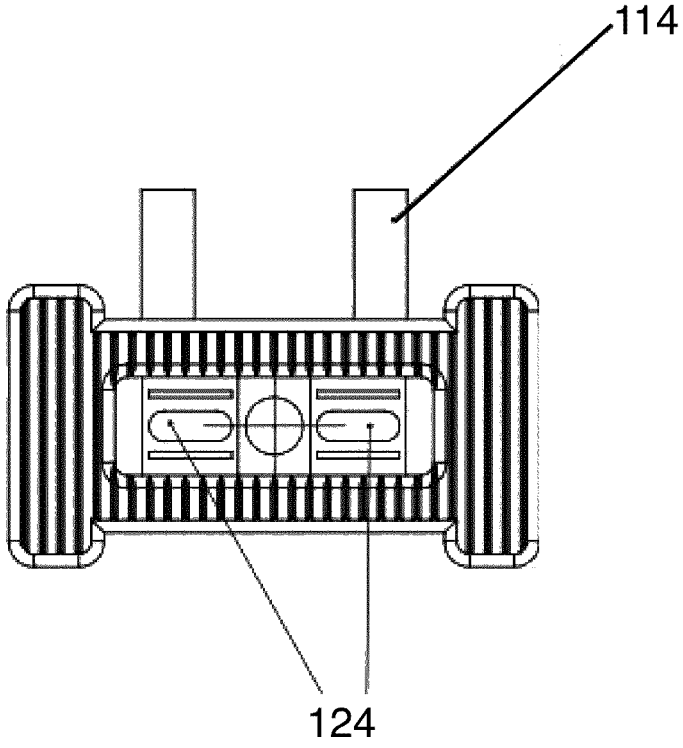
FIG. 37 is a bottom view of the hidden clip of FIG. 35.

FIGS. 35-37 show an alternative embodiment of the hidden clip 104 including one or more tracking grooves 110*c* defined into the top surface of the clip to aid in the movement through the magazine. A crush aperture or hole 124 is also defined in the body to allow for future expansion/contraction of adjacent deck boards/flooring.

Figure 38:
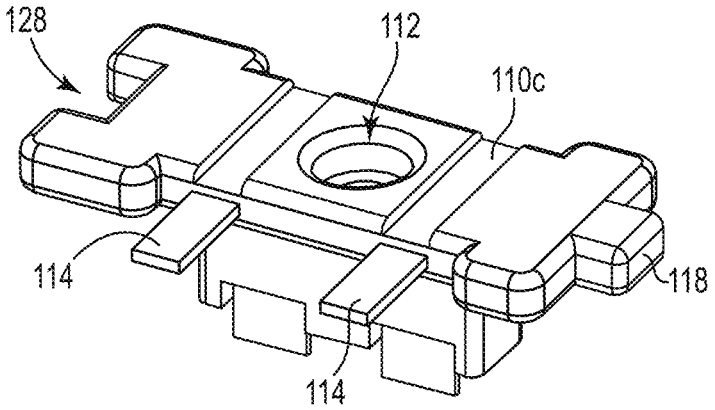
FIG. 38 is a perspective view of a hidden clip having tracking grooves and recess and protruding tab to facilitate registration, in accordance with embodiments of the present invention.

FIG. 38 shows an alternative embodiment of the hidden clip 104. Opposing sides of the body are provided with a respective recess 128 and protruding tab 118 to enhance the registration of the clip 104 when being advanced through the magazine 102*a*. This configuration also can be used to prevent the strip of clips 116 from being inserted backwards into the magazine by the user.

Figure 39:
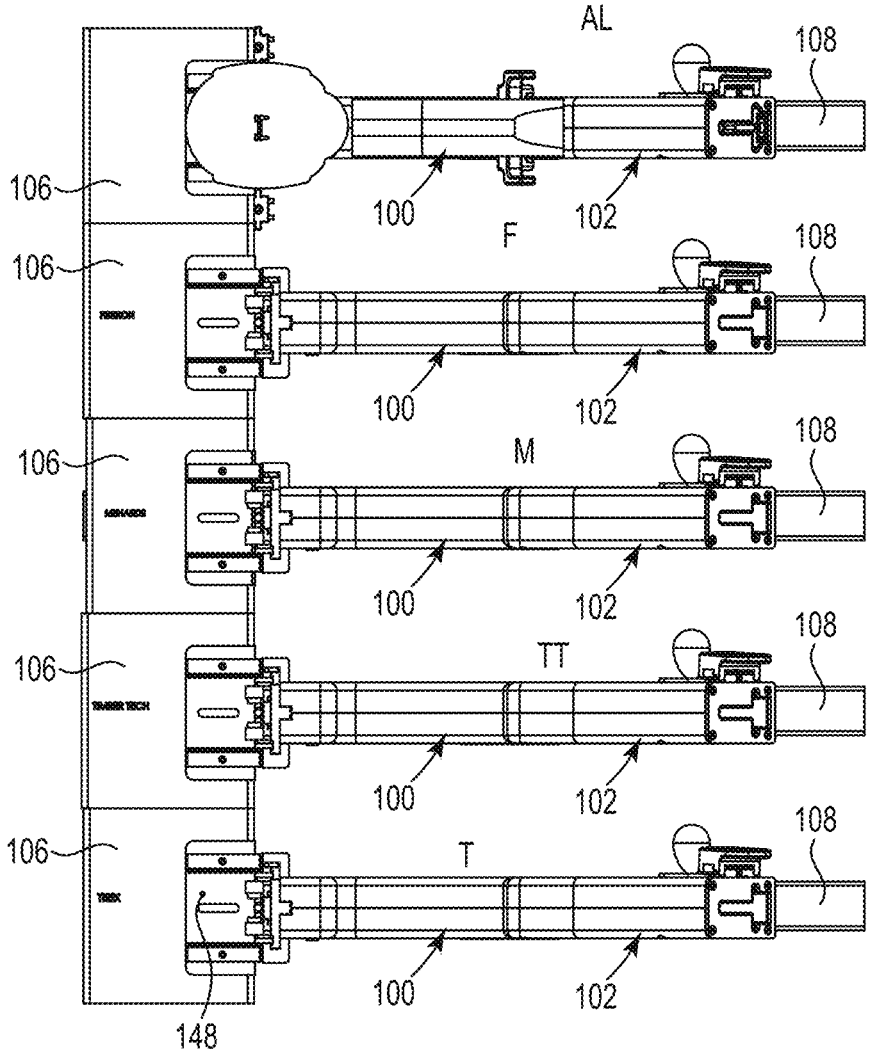
FIGS. 39-41 show a plurality of adjustment kit components for use with different industry composite board layouts and configurations, in accordance with embodiments of the present invention.
Figures 40, 41:
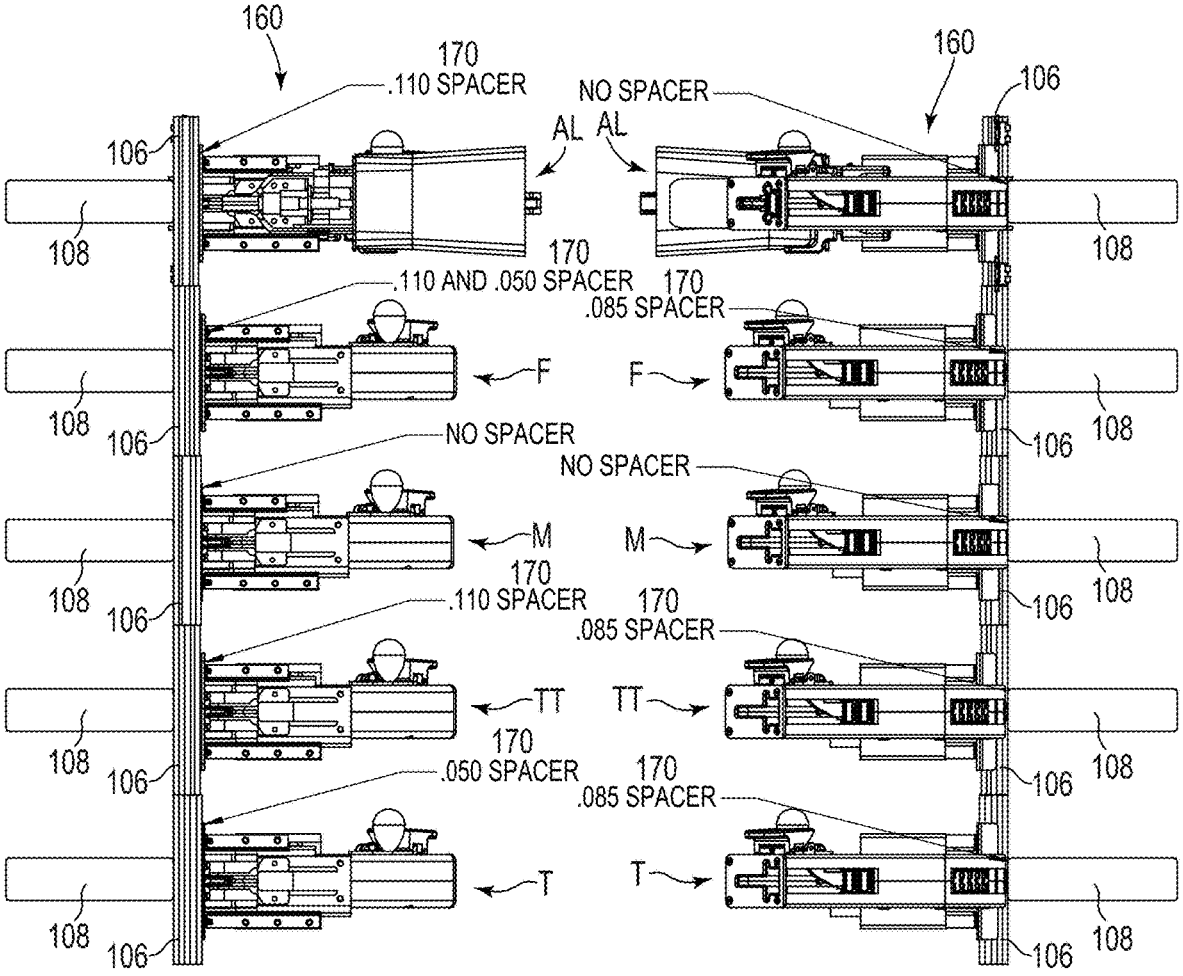

FIGS. 39-41 show various adjustment kit components 160 for use with industry composite board layouts and configurations. The one or more kits can include alignment plate, spacer, or shim elements for specific deck board configurations to facilitate fixation and alignment during operation of the present invention to secure the boards in place with the hidden clips 104. As such, the tool of the present invention can be used to secure various industry boards with varying dimensions and spacing requirements. For instance, boards made by or sold under the brands Armadillo (AL), Fiberon (F), Menards (M), Timber Tech (TT), Trex (T), and many others, can be affixed and secured with the present invention due to the inclusion of varying sized and shaped nose alignment plates, spacer plates, spacer bars, and the like with kits 160 adapted for use with the tool of the present invention. Exemplary spacer elements 170 of 0.110 inches are shown for various AL, F, and TT deck boards, 0.085 inches for various F and T deck boards, and 0.050 inches for various F and T deck boards are provided. It will be understood that a myriad of spacer element 70 sizes and shapes can be provided to accomplish the flexible alignment and fixation to any number of deck board brands, sizes, and configurations without deviating from the scope of the present invention.

As can be appreciated, the user can operate the present invention with one hand while holding the deck board in place. The user also need not reload the tool for each hidden clip to be installed. Thus, the installation process requires less installers and installer time. This reduces costs and improves productivity.

Because various clips of the present invention are bilaterally symmetrical along a plane bisecting the clip along its midline to define front and back halves, the clip can be fastened in either forward or rearward orientations about the vertical axis. Thus, the entire strip of such clips can be inserted into the magazine beginning with either end. This means that the user cannot insert the strip backwards since the front end and rear ends of the strip are the same (e.g., interchangeable). The clips can also be bilaterally symmetrical along a plane bisecting the clip along its midline to define right and left halves.

The clips can be formed of a single material or multiple separate materials. For example, the clips can all comprise single type of plastic material. Alternatively, each clip may comprise multiple different materials in order to provide specialized properties such as those discussed herein.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. A decking clip assembly, comprising:

a plurality of operatively connected decking clips defining a clip strip, each of the plurality of decking clips including one or more connecting tabs configured to frangibly connect to an adjacent one of the plurality of decking clips, one or more compression tabs, and an aperture configured to receive a fastener, wherein each of the decking clips comprises:

a planar top portion, the planar top portion defining a leading edge and a trailing edge opposite the leading edge, wherein at least one connecting tab spans between a respective leading edge and trailing edge of adjacent decking clips in the clip strip; and a vertically extending portion that extends downward from a bottom surface of the planar top portion, wherein the one or more compression tabs extend vertically downward from a bottom surface of the vertically-extending portion.

2. The assembly of claim 1, wherein the one or more compression tabs are generally H-shaped.

3. The assembly of claim 1, wherein the one or more of the decking clips are generally T-shaped.

4. The assembly of claim 1, wherein the plurality of decking clips each include one or more compression apertures that extend perpendicular to the planar top portion and that are disposed adjacent to the aperture configured to receive a fastener.

5. The assembly of claim 1, wherein the plurality of decking clips each include one or more laterally extending alignment tabs that extend from the planar top portion in a direction perpendicular to the leading edge and to the trailing edge.

6. The assembly of claim 1, wherein the plurality of decking clips each include one or more top tracking grooves defined into the planar top portion and that extend from the leading edge to the trailing edge.

7. The assembly of claim 1, wherein the clip strip is configured for manual engagement with a decking board.

8. The assembly of claim 1, wherein the leading edge is beveled across an entirety thereof.

9. The assembly of claim 1, wherein both of the leading edge and the trailing edge are beveled across an entirety thereof.

10. The assembly of claim 1, wherein the plurality of decking clips are formed entirely of a plastic material.

11. The assembly of claim 1, further including a dummy clip located at one end of the clip strip, the dummy clip attached to one of the decking clips via a connecting tab, wherein the dummy clip lacks the aperture configured to receive a fastener.

12. The assembly of claim 1, further comprising a fastener disposed in each of the apertures configured to receive a fasteners for each of the decking clips such that each fastener extends partially above the planar top portion.

13. The assembly of claim 12, wherein the fastener is a screw.

14. A decking clip assembly, comprising:

a plurality of operatively connected decking clips defining a clip strip, each of the decking clips defining a leading edge and a trailing edge opposite the leading edge, wherein the leading edge is beveled across an entirety thereof, wherein at least one connecting tab spans between a respective leading edge and trailing edge of adjacent decking clips in the clip strip, and wherein each of the decking clips defines an aperture configured to receive a fastener;

a plurality of fasteners, wherein one of the fasteners is disposed in each of the apertures configured to receive the fastener for each of the decking clips such that each fastener extends partially above a top surface of the decking clip; and a dummy clip located at one end of the clip strip, the dummy clip attached to one of the decking clips via a connecting tab, wherein the dummy clip lacks the aperture configured to receive a fastener.

15. The assembly of claim 14, wherein each of the decking clips comprises:

a planar top portion;

a vertically extending portion that extends downward from a bottom surface of the planar top portion, wherein one or more compression tabs extend vertically downward from a bottom surface of the vertically-extending portion.

16. The assembly of claim 14, wherein the trailing edge is beveled across an entirety thereof.

17. The assembly of claim 14, wherein the clip strip is formed entirely of a plastic material.

18. The assembly of claim 14, wherein the fasteners are threaded.

19. A decking clip assembly, comprising:

a plurality of operatively connected decking clips defining a clip strip, each of the decking clips defining a leading edge and a trailing edge opposite the leading edge, wherein the leading edge is beveled across an entirety thereof, wherein at least one connecting tab spans between a respective leading edge and trailing edge of adjacent decking clips in the clip strip, and wherein each of the decking clips defines an aperture configured to receive a fastener; and a dummy clip located at one end of the clip strip, the dummy clip attached to one of the decking clips via a connecting tab, wherein the dummy clip lacks the aperture configured to receive a fastener.

* * * * *